US008650682B2

(12) United States Patent
Herman

(10) Patent No.: US 8,650,682 B2
(45) Date of Patent: Feb. 18, 2014

(54) MULTIFUNCTIONAL DISPLAY FOR HOSPITAL BED

(75) Inventor: Fred J. Herman, Perrysburg, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 662 days.

(21) Appl. No.: 12/715,798

(22) Filed: Mar. 2, 2010

(65) Prior Publication Data

US 2011/0214234 A1 Sep. 8, 2011

(51) Int. Cl.
*A47C 21/08* (2006.01)

(52) U.S. Cl.
USPC ..... 5/600; 5/425; 5/658; 5/430

(58) Field of Classification Search
USPC ..... 5/600, 425, 658
See application file for complete search history.

(56) References Cited

U.S. PATENT DOCUMENTS

| | | | | |
|---|---|---|---|---|
| 4,410,158 | A | 10/1983 | Maffei | |
| 4,640,485 | A | 2/1987 | Day et al. | |
| 5,181,288 | A | 1/1993 | Heaton et al. | |
| 5,403,251 | A | 4/1995 | Belsito et al. | |
| 5,407,163 | A | 4/1995 | Kramer et al. | |
| 5,542,138 | A * | 8/1996 | Williams et al. | 5/658 |
| 5,611,096 | A | 3/1997 | Bartlett et al. | |
| 5,664,270 | A | 9/1997 | Bell et al. | |
| 5,713,856 | A | 2/1998 | Eggers et al. | |
| 5,732,712 | A | 3/1998 | Adair | |
| 5,771,511 | A | 6/1998 | Kummer et al. | |
| 5,833,623 | A | 11/1998 | Mann et al. | |
| 6,014,784 | A | 1/2000 | Taylor et al. | |
| 6,146,523 | A | 11/2000 | Kenley et al. | |
| 6,279,183 | B1 | 8/2001 | Kummer et al. | |
| 6,339,410 | B1 | 1/2002 | Milner et al. | |
| 6,352,504 | B1 | 3/2002 | Ise et al. | |
| 6,353,950 | B1 | 3/2002 | Bartlett et al. | |
| 6,371,123 | B1 | 4/2002 | Stark et al. | |
| 6,486,792 | B1 | 11/2002 | Moster et al. | |
| 6,487,735 | B1 | 12/2002 | Jacques, II et al. | |
| 6,493,568 | B1 | 12/2002 | Bell et al. | |
| 6,510,049 | B2 | 1/2003 | Rosen | |
| 6,536,056 | B1 | 3/2003 | Vrzalik et al. | |
| 6,566,833 | B2 | 5/2003 | Bartlett | |
| 6,771,181 | B1 | 8/2004 | Hughen, Jr. | |
| 6,781,517 | B2 * | 8/2004 | Moster et al. | 5/425 |
| 6,829,796 | B2 | 12/2004 | Salvatini et al. | |
| 7,033,539 | B2 | 4/2006 | Krensky et al. | |
| 7,038,588 | B2 | 5/2006 | Boone et al. | |
| 7,076,818 | B2 | 7/2006 | Kummer et al. | |
| 7,154,397 | B2 | 12/2006 | Zerhusen et al. | |

(Continued)

FOREIGN PATENT DOCUMENTS

| | | |
|---|---|---|
| WO | WO 2004/021952 A2 | 3/2004 |
| WO | WO 2007/008830 A2 | 1/2007 |
| WO | WO 2007/008831 A2 | 1/2007 |

*Primary Examiner* — Peter M Cuomo
*Assistant Examiner* — Brittany Wilson
(74) *Attorney, Agent, or Firm* — Barnes & Thornburg LLP

(57) ABSTRACT

A patient support apparatus includes a frame and a siderail coupled to the frame for movement between raised and lowered positions. The patient support apparatus has a display screen that, in one embodiment, is coupled to the siderail and in another embodiment is coupled to the frame with a flexible arm. The display screen displays a first graphical user interface when the display screen is positioned at a first position and a second graphical user interface when the display screen is positioned at a second position.

14 Claims, 3 Drawing Sheets

(56) References Cited

U.S. PATENT DOCUMENTS

| | | | | |
|---|---|---|---|---|
| 7,237,287 | B2 | 7/2007 | Weismiller et al. | |
| 7,506,390 | B2 | 3/2009 | Dixon et al. | |
| 7,679,520 | B2 | 3/2010 | Zerhusen et al. | |
| 7,779,493 | B2 * | 8/2010 | Lemire et al. | 5/600 |
| 8,006,332 | B2 * | 8/2011 | Lemire et al. | 5/600 |
| 2002/0111701 | A1 | 8/2002 | Borders | |
| 2004/0227737 | A1 | 11/2004 | Novak et al. | |
| 2005/0128184 | A1 | 6/2005 | McGreevy | |
| 2005/0166324 | A1 | 8/2005 | Dixon et al. | |
| 2005/0172405 | A1 | 8/2005 | Menkedick et al. | |
| 2005/0273940 | A1 | 12/2005 | Petrosenko et al. | |
| 2005/0288571 | A1 | 12/2005 | Perkins et al. | |
| 2006/0101581 | A1 | 5/2006 | Blanchard et al. | |
| 2006/0103636 | A1 | 5/2006 | Parsons | |
| 2006/0229557 | A1 | 10/2006 | Fathallah et al. | |
| 2007/0066866 | A1 | 3/2007 | Noguchi et al. | |
| 2007/0120689 | A1 | 5/2007 | Zerhusen et al. | |
| 2007/0163045 | A1 | 7/2007 | Becker et al. | |
| 2007/0164871 | A1 | 7/2007 | Dionne et al. | |
| 2007/0174964 | A1 | 8/2007 | Lemire et al. | |
| 2007/0180616 | A1 * | 8/2007 | Newkirk et al. | 5/425 |
| 2008/0235872 | A1 | 10/2008 | Newkirk et al. | |

* cited by examiner

MULTIFUNCTIONAL DISPLAY FOR HOSPITAL BED

BACKGROUND

The present disclosure relates to patient support apparatuses, such as hospital beds. More particularly, the present disclosure relates to displays for hospital beds that are used to control various functions of the hospital bed.

Patient support apparatuses, such as hospital beds, have user inputs that are used to control various features and functions of the beds. Examples of some of the functions that a hospital bed may have include raising or lowering one or more sections of the bed; adjusting a configuration of a bed frame, support surface, or any portion thereof; and activating or deactivating alarms, communications, and other automated features of the patient support. Some patient support apparatuses include mattresses that are sometimes configured to provide therapeutic functions and/or features to the patient, including pressure redistribution, turning assistance, rotation, percussion and vibration, low air loss, and the like. Additionally, some patient support apparatuses provide various communications and control functions, such as calling the nurse, adjusting the room light or reading light, controlling video functions (television, streaming media, DVD, etc.) and audio functions, accessing the Internet, preparing email, or controlling the telephone. Patient support apparatuses that offer such functions may include a user interface device to provide the caregiver and/or other persons control over the operation of those functions.

SUMMARY

The present invention comprises one or more of the features recited in the appended claims and/or the following features which, alone or in any combination, may comprise patentable subject matter:

According to one aspect, a patient support apparatus may include a frame, a siderail coupled to the frame and movable between raised and lowered positions relative to the frame, and a display screen pivotably coupled to the siderail. The display screen may be pivotable about a first axis. The display screen may display a first graphical user interface when the display screen is positioned at a first position about the first axis and a second graphical user interface when the display screen is positioned at a second position about the first axis.

In some embodiments, the display screen may be pivotable about a second axis that is orthogonal to the first axis. In some embodiments, the first graphical user interface may be a caregiver interface. In some embodiments, the second graphical user interface may be a patient interface.

In some embodiments, the display screen may be controlled based on a signal received from a position sensor operable to measure the position of the display screen relative to gravity. Additionally, in some embodiments, the position sensor may be an accelerometer. In some embodiments, the patient support apparatus may further include an electronic controller electrically coupled to the display screen and the position sensor. The controller may include a processor and a memory device electrically coupled to the processor. The memory device may have stored therein a plurality of instructions which, when executed by the processor, cause the processor to communicate with the position sensor to determine a current position of the display screen, operate the display screen to generate the first graphical user interface when the current position is the first position, and operate the display screen to generate the second graphical user interface when the current position is the second position.

In some embodiments, the display screen may be a touchscreen operable to receive user input. In some embodiments, the display screen may be received in a slot formed in the siderail when the display screen is positioned in the first position. Additionally, in some embodiments, the first graphical user interface may face outwardly away from the patient support surface when the display screen is positioned in the first position.

In some embodiments, the first graphical user interface may have a first viewing orientation, and the second graphical user interface may have a second viewing orientation. The second viewing orientation may be upside down from the first viewing orientation.

According to another aspect, a siderail for a patient support apparatus may include a panel configured to be coupled to the patient support apparatus and a display screen pivotably coupled to the panel. The display screen may be pivotable about a first axis. The siderail also may have a position sensor operable to measure the position of the display screen about the first axis and an electronic controller electrically coupled to the display screen and the position sensor. The controller may include a processor and a memory device electrically coupled to the processor. The memory device may have stored therein a plurality of instructions which, when executed by the processor, cause the processor to communicate with the position sensor to determine a current position of the display screen about the first axis and operate the display screen to generate a graphical user interface based on the current position.

In some embodiments, the graphical user interface may be a caregiver interface when the current position is a first position about the first axis. In some embodiments, the graphical user interface may be a patient interface when the current position is a second position about the first axis. In some embodiments of the siderail, the position sensor may be an accelerometer.

According to another aspect, a patient support apparatus may include a frame, a flexible mounting arm coupled to the frame at a first end, and a display screen secured to the second end of the flexible mounting arm. The display screen may display a caregiver interface when the display screen is placed in a first position relative to the patient support surface and a patient interface when the display screen is placed in a second position relative to the patient support surface.

In some embodiments, the patient support apparatus may include an electronic controller electrically coupled to the display screen and the position sensor. The controller may include a processor and a memory device electrically coupled to the processor. The memory device has stored therein a plurality of instructions which, when executed by the processor, cause the processor to communicate with the position sensor to determine a current position of the display screen relative to the patient support surface, operate the display screen to generate the caregiver interface when the current position is the first position, and operate the display screen to generate the patient interface when the current position is the second position. In some embodiments, the flexible mounting arm may define an arc when the display screen is placed in the second position.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
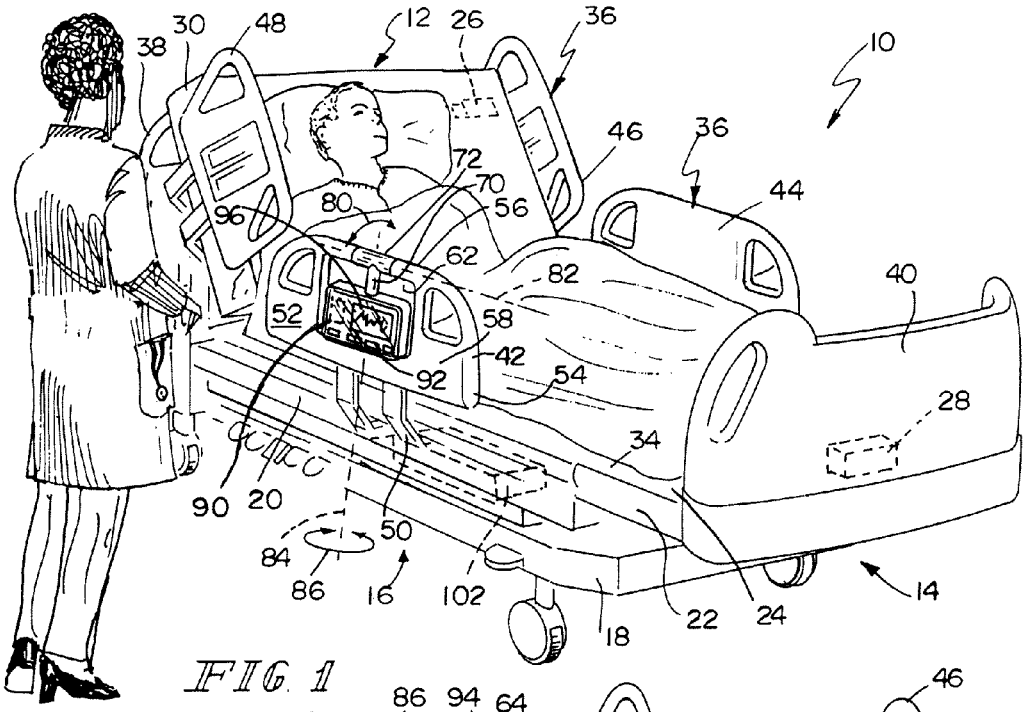
FIG. 1 is a perspective view of a patient support apparatus including one embodiment of a multifunctional display screen.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, there is shown a patient support apparatus 10. The TotalCare® bed, which is commercially available from the Hill-Rom Company, Inc. of Batesville, Ind., U.S.A., is an example of a patient support apparatus. While the patient support apparatus 10 in the present embodiment is illustratively shown as a hospital bed, a patient support apparatus may also include other apparatuses for supporting a patient, including, for example, birthing beds, stretchers, bariatric beds, and tables of varying types, such as operating room tables, diagnostic tables, and examination tables.

The patient support apparatus 10 has a head end 12 and a foot end 14 and includes a bed frame 16. The bed frame 16 has a base 18, an intermediate frame 20 positioned above the base 18, and a deck 22 positioned above the frame 20. A patient support surface 24 is supported by the deck 22. The support surface 24 includes a cover defining an interior region in which a variety of support components such as air bladders, foam, three-dimensional thermoplastic fibers, and/or other support elements may be arranged. In the illustrated embodiment, air bladders are configured to provide one or more therapeutic services to a person positioned on the support surface 24.

The bed frame 16 also includes a lift mechanism to raise and lower the frame 20 relative to the base 18, a head articulation mechanism to raise and lower a head and/or upper torso section 30 of the support surface 24, and foot articulation mechanism to raise and lower a lower body section 34 of the support surface 24. As such, the patient support apparatus 10 is configured to assume a variety of positions, including a horizontal position, a chair-like position, Trendelenburg, reverse Trendelenburg, and/or other positions.

Angle sensors 26, 28 enable automatic detection of a change in position of sections of the support surface 24. The head of bed angle sensor 26 generates an electrical output signal indicative of the movement of head section 30 while it is being raised or lowered and transmits that electrical output signal to a bed control system 32 (see FIG. 3). Similarly, the foot of bed angle sensor 28 generates an electrical output signal indicative of the movement of lower body section 34 while it is being raised or lowered and transmits that electrical output signal to the control system 32. The sensors 26, 28 may be embodied as potentiometers, ball switches, accelerometers, inclinometers, or any other type of device that is usable to measure or determine an angle or relative position and produce an output relating to the angle or position. It will be appreciated that in other embodiments sensors may indicate whether a section of the support surface 24 is positioned in an "up" or "down" position, is positioned at a particular angle relative to the frame 20 or other horizontal axis, or is positioned within or outside a particular range of angles.

The patient support apparatus 10 also has a number of barriers 36 positioned adjacent to the perimeter of the support surface 24. The number of barriers 36 include a headboard 38 positioned at the head end 12, a footboard 40 positioned at the foot end 14, and siderails 42, 44, 46, 48 coupled to the frame 20 via couplers 50. The couplers 50 are configured to move the siderails 42, 44, 46, 48 from a raised position, as shown in FIG. 1, to a lowered position (not shown). It will be appreciated that in other embodiments the patient support apparatus 10 may include fewer barriers, or, alternatively, more barriers, than those shown and described in the illustrative embodiment.

Figure 2:
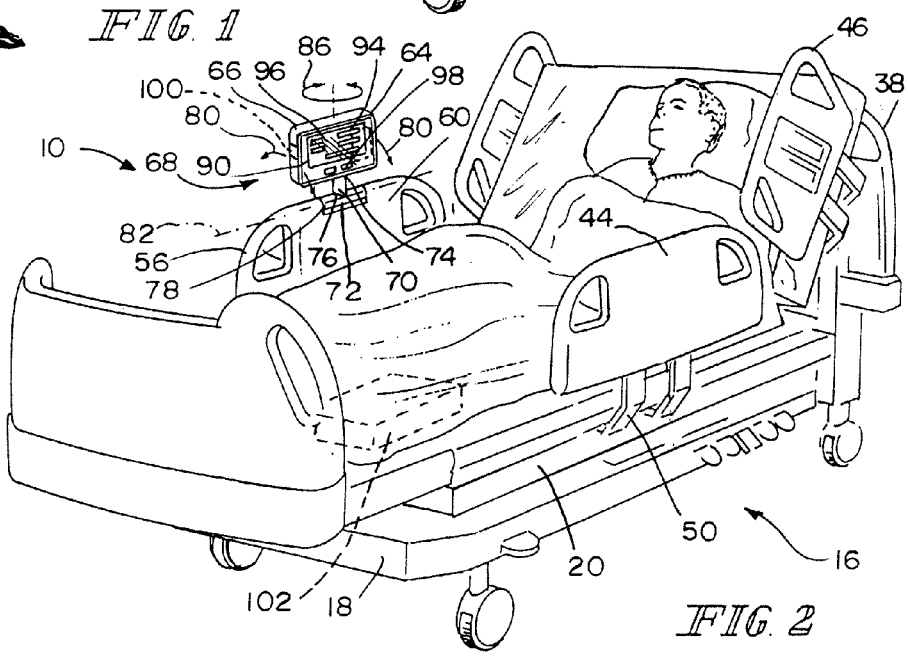
FIG. 2 is another perspective view of the patient support apparatus of FIG. 1 showing the multifunctional display in another position.

Referring now to FIGS. 1 and 2, the siderail 42 includes a panel 52 extending from a lower end 54 secured to the couplers 50 to an upper end 56 positioned above the support surface 24. The panel 52 has an outward side 58, which faces away from the frame 16, and an inward side 60, which faces opposite the outward side 54 toward the frame 16. The outward side 58 has a recess or slot 62 formed therein that receives an interface device 64, as shown in FIG. 1. It will be appreciated that in other embodiments the recess 62 may be an opening extending through the panel 52 from the outward side 58 to the inward side 60.

The interface device 64 includes a housing 66 and a mounting arm 68 extending away from the housing 66. The mounting arm 68 includes a pair of shafts 70, 72. The shaft 70 extends from an end 74 coupled to the housing 66 to an end 76 secured to the shaft 72. The shaft 72 extends orthogonally to the shaft 70 and is pivotably coupled to the upper end 56 of the panel 52 at a pivot joint 78. As indicated by arrows 80 in FIGS. 1 and 2, the interface device 64 is movable about an axis 82 extending longitudinally through the shaft 72. The interface device 64 is also movable about an axis 84 extending through the shaft 70 perpendicular to the axis 82, as indicated by arrows 86.

A multifunctional display screen 90 is positioned in the housing 66, and the display screen 90 is operable to generate or display multiple graphical user interfaces 92, 94 that enable a person to electronically control one or more features of the patient support apparatus 10, including, for example, positioning of the sections of the deck 22 and support surface 24. When the interface device 64 is positioned in the recess 62, the display screen 90 faces away from the frame 16 and the support surface 24. The graphical user interface 92 has one viewing orientation (see FIG. 1) when the interface device 64 is positioned in the recess 62 while the graphical user interface 94 has another viewing orientation (see FIG. 2) when the interface device 64 is positioned above the panel 52. In the illustrative embodiment, the viewing orientation of the graphical user interface 94 is upside down from the viewing orientation of the graphical user interface 92. The display screen 90 is embodied as a touchscreen that displays or generates graphics 96 and controls 98 as part of the graphical user interfaces 92, 94. As will be discussed in greater detail below, the position of the interface device 64 about the axis 82 determines which graphics 96 and controls 98 are displayed by the display screen 90.

A position sensor 100 is positioned in the housing 66 to monitor the position of the interface device 64 about the axis 82. As embodied in FIGS. 1 and 2, the position sensor 100 is an accelerometer that provides an indication of the position of the interface device 64 relative to gravity and generates an electrical output signal indicative of that position. As the interface device 64 moves about the axis 82, the output signal changes by a proportionate amount. One example of an accelerometer is a Three Axis Low-g Micromachined Accelerometer, model number MMA7260QT, commercially available from Freescale Semiconductor of Tempe, Ariz., U.S.A. It will be appreciated that in other embodiments the position sensor 100 may comprise one or more of a ball switch, potentiometer, inclinometer, or any other type of device that is usable to measure or determine a position and produce an output indicative of the position. It will also be appreciated that position sensor 100 may be situated outside housing 66, such as being coupled to shaft 72 and/or to shaft 70.

The control system 32 for the patient support apparatus 10 includes an electrical junction box 102 that is secured to the bed frame 16. U.S. Pat. No. 5,771,511, which is entitled "Communication Network for a Hospital Bed," describes an exemplary control system 32 and is expressly incorporated herein by reference. U.S. Pat. No. 7,506,390, which is entitled "Patient Support Apparatus Having a Controller Area Network," describes another exemplary embodiment of control system 32 and is expressly incorporated herein by reference.

Figure 3:
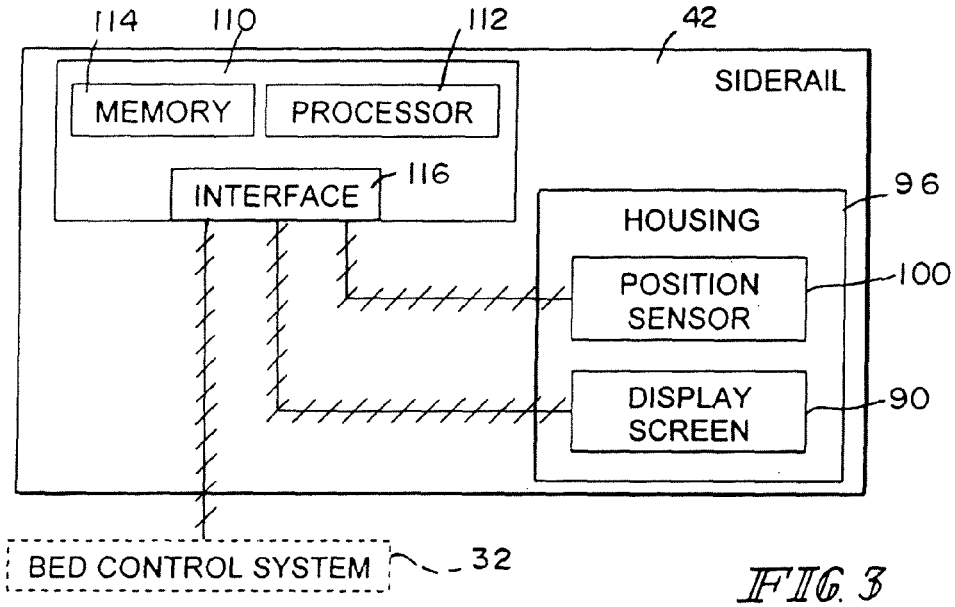
FIG. 3 is a simplified block diagram of one illustrative embodiment of a siderail including the multifunctional display screen of FIGS. 1 and 2.

Referring now to FIG. 3, the siderail 42 is shown in a simplified block diagram. As discussed above, the siderail 42 includes the display screen 90 and the position sensor 100. The siderail 42 also includes an electronic control unit (ECU) or "electronic controller" 110 in electronic communication with the display screen 90, the position sensor 100, and the bed control system 32. The electronic controller 110 is responsible for interpreting electrical signals sent by the display screen 90, sensor 100, and the bed control system 32. Based on those signals, the electronic controller 110 controls the operation of the display screen 90. To do so, the electronic controller 110 includes a number of electronic components commonly associated with electronic units utilized in the control of electromechanical systems. For example, the electronic controller 110 may include, amongst other components customarily included in such devices, a processor such as a microprocessor 112 and a memory device 114 such as a programmable read-only memory device ("PROM") including erasable PROM's (EPROM's or EEPROM's). The memory device 114 is provided to store, amongst other things, instructions in the form of, for example, a software routine (or routines) which, when executed by the microprocessor 112, allows the electronic controller 110 to control operation of the display screen 90.

The electronic controller 110 also includes an analog interface circuit 116. The analog interface circuit 116 converts the output signal from the various electronic components, (e.g., position sensor 100) into a signal which is suitable for presentation to an input of the microprocessor 112. In particular, the analog interface circuit 116, by use of an analog-to-digital (A/D) converter (not shown) or the like, converts the analog signals generated by the sensors into digital signals for use by the microprocessor 112. It should be appreciated that the A/D converter may be embodied as a discrete device or number of devices, or may be integrated into the microprocessor 112. It should also be appreciated that if any of the components generate a digital output signal, the analog interface circuit 116 may be bypassed.

Similarly, the analog interface circuit 116 converts signals from the microprocessor 112 into output signals which are suitable for the display screen 90 and the bed control system 32. In particular, the analog interface circuit 116, by use of a digital-to-analog (D/A) converter (not shown) or the like, converts the digital signals generated by the microprocessor 112 into analog signals for use by the various electronic components (e.g., control system 32). It should be appreciated that, similar to the A/D converter described above, the D/A converter may be embodied as a discrete device or number of devices, or may be integrated into the microprocessor 112. It should also be appreciated that if any of the components operate on a digital input signal, the analog interface circuit 116 may be bypassed.

Thus, the electronic controller 110 may control the operation of the display screen 90 in accordance with the signals received from the position sensor 100 and the bed control system 32. In particular, the electronic controller 110 executes a routine including, amongst other things, a control scheme in which the electronic controller 110 monitors output of the position sensor 100 to control the graphical user interface generated by the display screen 90, as described below.

Figure 4:
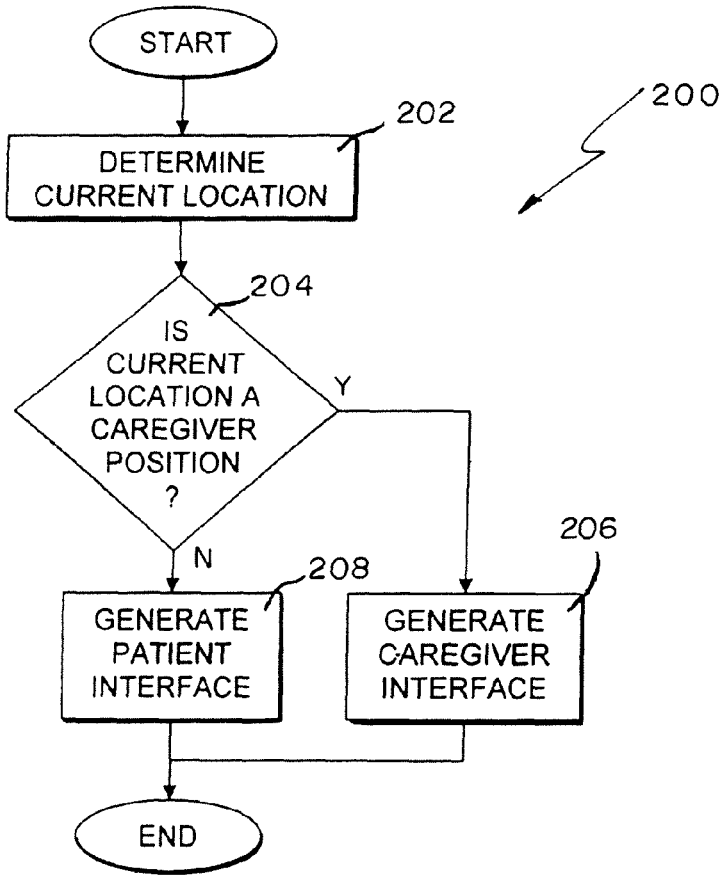
FIG. 4 is a simplified flow chart of a control routine for operating the multifunctional display screen of FIGS. 1-3.

Referring now to FIG. 4, an illustrative embodiment of a control routine 200 for operating the display screen 90 is shown. The control routine 200 begins with step 202 in which the controller 110 communicates with the position sensor 100 to determine the current position or location of the interface device 64 about the axis 82. In the illustrative embodiment described herein, the sensor 100 measures the position of the interface device 64 relative to gravity and generates an electrical output signal indicative thereof. The controller 110 receives the electrical output signal and determines where the interface device 64 is presently or currently located about the axis 82. Once the current location of the interface device 64 has been determined, the routine 200 advances to step 204.

In step 204, the controller 110 compares the current location of the interface device 64 to a plurality of caregiver display positions stored in the memory device 114. The plurality of caregiver display positions may be stored as a range of positions about the axis 82 or as a number of discrete positions. As shown in FIG. 1, the interface device 64 is positioned in one of the caregiver positions. When the controller 110 determines that the current location of the interface device 64 is one of the caregiver display positions, the routine 200 advances to step 206. When the controller 110 determines that the current location is not one of the caregiver display positions, the routine 200 advances to step 208.

In step 206, the controller 110 operates the display screen 90 to generate a caregiver interface on the display screen 90. The term "caregiver interface" is defined herein as a graphical user interface including graphics and controls that enable the caregiver to control all features and functions of the patient support apparatus. In some embodiments, those features include positioning of the support surface 24, activating or deactivating therapeutic functions, operating patient lock-out functions, and controlling any other function of the patient support apparatus 10. The caregiver interface may also provide the caregiver with access to the patient's physiological data, such as, for example, the patient's current heart rate and brain activity, as well as historical data. Additionally, the caregiver interface may provide the caregiver with access to the patient's electronic medical records. As shown in FIG. 1, the graphical user interface 92 is one embodiment of the caregiver interface.

Returning to step 204, when the current location of the interface device 64 is not one of the caregiver display positions, the routine 200 advances to step 208. In step 208, the controller 110 operates the display screen 90 to generate a patient interface on the display screen 90. The term "patient interface" is defined herein as a graphical user interface that includes graphics and controls that enable the patient to control a subset of the features and functions of the patient support apparatus. For example, the patient interface may enable the patient to use various communication and control functions, such as, for example, calling the nurse, adjusting the room light or reading light, controlling video functions (television, streaming media, DVD, etc.) and audio functions, accessing the Internet, preparing email, or controlling the telephone. Additionally, the patient interface may enable the patient to change the positioning of the support surface 24. The number of features and functions that may be accessed using the patient interface may be set by the caregiver using the caregiver interface or may be limited by the bed manufacturer. As shown in FIG. 2, the graphical user interface 94 is one embodiment of the patient interface.

It will be appreciated that in other embodiments the caregiver may wish to share information available only on the caregiver interface. In such embodiments, the caregiver interface may include a lock control that the caregiver may activate to maintain the caregiver interface. When the lock control is activated, the display screen 90 generates only the caregiver interface, regardless of the position of the interface device 64 about the axis 82.

Figure 5:
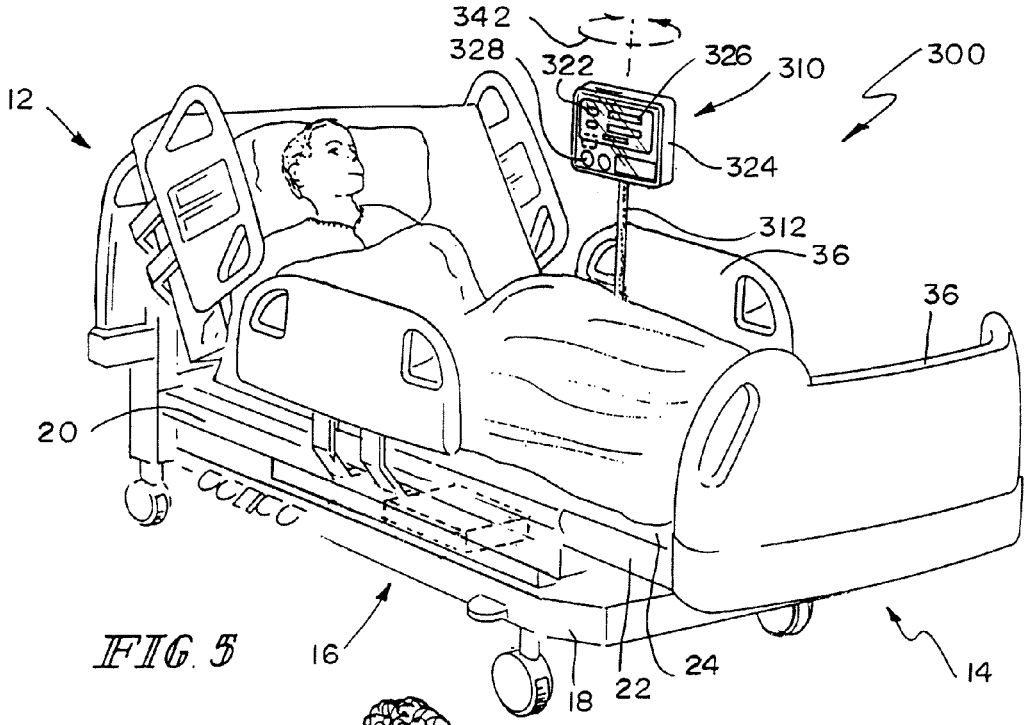
FIG. 5 is a perspective view of a patient support apparatus including another embodiment of the multifunctional display screen.
Figure 6:
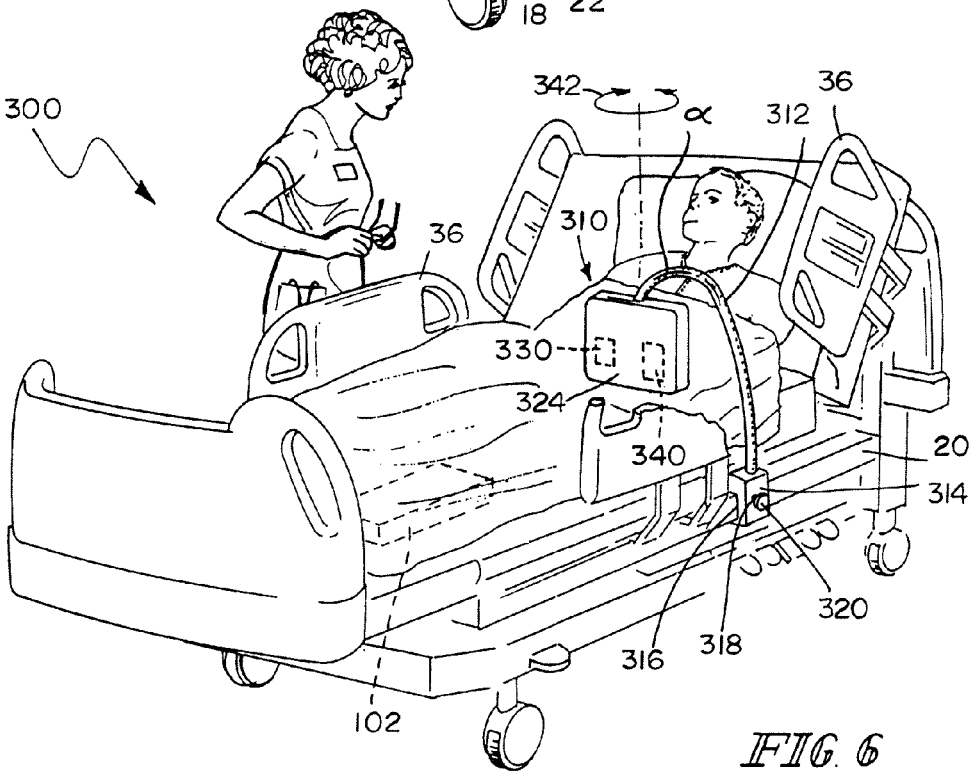
FIG. 6 is another perspective view of the patient support apparatus of FIG. 5 showing the multifunctional display screen in another position.

Referring now to FIGS. 5 and 6, another embodiment of a patient support apparatus is illustrated. Some features of the embodiment illustrated in FIGS. 5 and 6 are substantially similar to those discussed above in reference to the embodiment of FIGS. 1-4. Such features are designated in FIGS. 5 and 6 with the same reference numbers as those used in FIGS. 1-4.

Referring now to FIG. 5, a patient support apparatus 300 is shown. The patient support apparatus 300 has a head end 12 and a foot end 14 and includes a bed frame 16. The bed frame 16 has a base 18, an intermediate frame 20 positioned above the base 18, and a deck 22 positioned above the frame 20. A patient support surface 24 is supported by the deck 22. The patient support apparatus 300 also includes a control system 32 having an electrical junction box 102 that is coupled to the bed frame 16. The patient support apparatus 300 also has a number of barriers 36 positioned adjacent to the perimeter of the support surface 24.

The patient support apparatus 300 has an interface device 310 coupled to the frame 20 via a flexible mounting arm 312 (see FIG. 6). The flexible mounting arm 312 is coupled to a bracket 314 having a channel 316 defined therein. The channel 316 is sized to receive a portion of the frame 16 and includes a pair of flanges (not shown) that extend over the portion of the frame 16. A threaded fastener 318 having a knob 320 is threaded through the bracket 314 into the channel 316. When the knob 320 is turned in one direction, the fastener 318 is advanced into contact with the frame 16, thereby securing the bracket 314 to the frame 16. When the knob 320 is turned in the opposite direction, the fastener 318 is advanced out of contact with the frame 16, which permits the user to adjust the position of the bracket 314 along the frame 16. It will be appreciated that in other embodiments other fastening means may be used to fix the bracket 314 into position. It will also be appreciated that in other embodiments the flexible mounting arm 312 may be secured to other parts of the patient support apparatus 300, such as, for example, any of the barriers 36.

The flexible mounting arm 312 is operable to place the interface device 310 in a number of positions relative to the support surface 24. As shown in FIGS. 5 and 6, the flexible mounting arm 312 has sufficient flexibility to bend and/or twist to change the position and orientation of the interface device 310 and sufficient structural rigidity to maintain its position. In the illustrative embodiment, the flexible mounting arm 312 is made of spring steel and is covered with vinyl. The flexible mounting arm 312 includes a passageway (not shown) sized to receive electrical wiring that connects the interface device 310 with the control system 32. One example of a flexible mounting arm is a Moffatt Flex Arm, commercially available from Moffatt Products, Inc. of Watertown, S. Dak., U.S.A.

The interface device 310 includes a housing 324 that is coupled to the flexible mounting arm 312. A multifunctional display screen 322 is positioned in the housing 324, and the display screen 322 is operable to generate multiple graphical user interfaces that enable a person to electronically control one or more features of the patient support apparatus 300, including, for example, positioning of the sections of the support surface 24. The display screen 322 is embodied as a touchscreen that generates or displays graphics 326 and controls 328 as part of the graphical user interfaces. Similar to the display screen 90 discussed above in connection with FIGS. 1-4, the position of the interface device 310 determines which graphics 326 and controls 328 are generated or displayed by the display screen 322.

A position sensor 330 is also positioned in the housing 324 to monitor the position of the interface device 310 relative to the support surface 24. As embodied in FIGS. 5 and 6, the position sensor 330 is an accelerometer that provides an indication of the position of the interface device 310 relative to gravity and generates an electrical output signal indicative of that position. As the interface device 310 moves relative to the support surface 24, the output signal changes by a proportionate amount. It will be appreciated that in other embodiments the position sensor 330 may comprises one or more of a ball switch, potentiometer, inclinometer, or any other type of device that is usable to measure or determine a position and produce an output indicative of the position.

The interface device 310 also includes an electronic controller 340. The electronic controller 340, like the electronic controller 110 discussed above in connection with FIGS. 1-4, is responsible for interpreting electrical signals sent by the display screen 322, sensor 330, and the bed control system 32. Similar to the electronic controller 110, the electronic controller 340 controls the operation of the display screen 322 in accordance with the information received from the position sensor 330 and the bed control system 32. In particular, the electronic controller 340 executes a routine including, amongst other things, a control scheme in which the electronic controller 340 monitors output of the position sensor 330 to control the graphical user interface generated by the display screen 322.

To do so, the electronic controller 340 executes a control scheme similar to that shown in FIG. 4. The controller 340 communicates with the position sensor 330 to determine the current position or location of the interface device 310 relative to the support surface 24. The controller 340 then compares the current location of the interface device 310 to a plurality of caregiver display positions stored in the memory device of the controller 340. The plurality of caregiver display positions may be stored as a range of positions relative to the support surface 24. As shown in FIG. 5, the interface device 310 is positioned in one of the caregiver positions. When the controller 340 determines that the current location of the interface device 310 is one of the caregiver positions, the controller 340 operates the display screen 322 to generate a caregiver interface on the display screen 322. In FIG. 5, one embodiment of a caregiver interface is shown on the display screen 322.

When the current location of the interface device 310 is not one of the caregiver display positions, the controller 340 operates the display screen 322 to generate a patient interface on the display screen 322. When located in the position shown in FIG. 6, the display screen 322 generates a patient interface. As shown in FIG. 6, the flexible mounting arm 312 defines an arc $\alpha$ and may be twisted as indicated by arrow 342.

Although certain illustrative embodiments have been described in detail above, variations and modifications exist within the scope and spirit of this disclosure as described and as defined in the following claims.

The invention claimed is:

1. A patient support apparatus comprising a frame, a siderail coupled to the frame and movable between raised and lowered positions relative to the frame, and a display screen pivotably coupled to the siderail, the display screen being pivotable about a first axis, wherein the display screen displays (i) a first graphical user interface when the display screen is positioned at a first position about the first axis, and (ii) a second graphical user interface when the display screen is positioned at a second position about the first axis, wherein the display screen is controlled based on a signal received from a position sensor operable to measure the position of the display screen relative to gravity.

2. The patient support apparatus of claim 1, wherein the display screen is pivotable about a second axis, the second axis being orthogonal to the first axis.

3. The patient support apparatus of claim 1, wherein the first graphical user interface is a caregiver interface.

4. The patient support apparatus of claim 3, wherein the second graphical user interface is a patient interface.

5. The patient support apparatus of claim 1, wherein the position sensor comprises an accelerometer.

6. The patient support apparatus of claim 1, further comprising an electronic controller electrically coupled to the display screen and the position sensor, the controller comprising (i) a processor, and (ii) a memory device electrically coupled to the processor, the memory device having stored therein a plurality of instructions which, when executed by the processor, cause the processor to (i) communicate with the position sensor to determine a current position of the display screen, (ii) operate the display screen to generate the first graphical user interface when the current position is the first position, and (iii) operate the display screen to generate the second graphical user interface when the current position is the second position.

7. A patient support apparatus comprising a frame, a siderail coupled to the frame and movable between raised and lowered positions relative to the frame, and a display screen pivotably coupled to the siderail, the display screen being pivotable about a first axis, wherein the display screen displays (i) a first graphical user interface when the display screen is positioned at a first position about the first axis, and (ii) a second graphical user interface when the display screen is positioned at a second position about the first axis, wherein the display screen is a touchscreen operable to receive user input.

8. A patient support apparatus comprising a frame, a siderail coupled to the frame and movable between raised and lowered positions relative to the frame, and a display screen pivotably coupled to the siderail, the display screen being pivotable about a first axis, wherein the display screen displays (i) a first graphical user interface when the display screen is positioned at a first position about the first axis, and (ii) a second graphical user interface when the display screen is positioned at a second position about the first axis, wherein the display screen is received in a slot formed in the siderail when the display screen is positioned in the first position.

9. A patient support apparatus comprising a frame, a siderail coupled to the frame and movable between raised and lowered positions relative to the frame, and a display screen pivotably coupled to the siderail, the display screen being pivotable about a first axis, wherein the display screen displays (i) a first graphical user interface when the display screen is positioned at a first position about the first axis, and (ii) a second graphical user interface when the display screen is positioned at a second position about the first axis, wherein the first graphical user interface faces outwardly away from the patient support surface when the display screen is positioned in the first position.

10. A patient support apparatus comprising a frame, a siderail coupled to the frame and movable between raised and lowered positions relative to the frame, and a display screen pivotably coupled to the siderail, the display screen being pivotable about a first axis, wherein the display screen displays (i) a first graphical user interface when the display screen is positioned at a first position about the first axis, and (ii) a second graphical user interface when the display screen is positioned at a second position about the first axis, wherein the first graphical user interface has a first viewing orientation, the second graphical user interface has a second viewing orientation, and the second viewing orientation is upside down from the first viewing orientation.

11. A siderail for a patient support apparatus comprising a panel configured to be coupled to the patient support apparatus, a display screen pivotably coupled to the panel, the display screen being pivotable about a first axis, a position sensor operable to measure the position of the display screen about the first axis, and an electronic controller electrically coupled to the display screen and the position sensor, the controller comprising (i) a processor, and (ii) a memory device electrically coupled to the processor, the memory device having stored therein a plurality of instructions which, when executed by the processor, cause the processor to (i) communicate with the position sensor to determine a current position of the display screen about the first axis, and (ii) operate the display screen to generate a graphical user interface based on the current position.

12. The siderail of claim 11, wherein the graphical user interface is a caregiver interface when the current position is a first position about the first axis.

13. The siderail of claim 12, wherein the graphical user interface is a patient interface when the current position is a second position about the first axis.

14. The siderail of claim 11, wherein the position sensor comprises an accelerometer.

* * * * *